US012480272B2

(12) United States Patent
Maersch

(10) Patent No.: US 12,480,272 B2
(45) Date of Patent: Nov. 25, 2025

(54) ELECTRICAL POLE WITH H-WEB CAISSON

(71) Applicant: AMERICAN TRANSMISSION COMPANY LLC, Waukesha, WI (US)

(72) Inventor: Todd Maersch, Madison, WI (US)

(73) Assignee: American Transmission Company LLC, Waukesha, WI (US)

( * ) Notice: Subject to any disclaimer, the term of this patent is extended or adjusted under 35 U.S.C. 154(b) by 191 days.

(21) Appl. No.: 18/169,478

(22) Filed: Feb. 15, 2023

(65) Prior Publication Data

US 2023/0265634 A1 Aug. 24, 2023

Related U.S. Application Data

(60) Provisional application No. 63/268,213, filed on Feb. 18, 2022.

(51) Int. Cl.

| | |
|---|---|
| ***E02D 23/00*** | (2006.01) |
| ***E02D 7/18*** | (2006.01) |
| ***E02D 27/42*** | (2006.01) |

(52) U.S. Cl.

CPC ..... *E02D 23/00* (2013.01); *E02D 7/18* (2013.01); *E02D 27/42* (2013.01); *E02D 2600/20* (2013.01)

(58) Field of Classification Search

CPC ..... E02D 23/00; E02D 7/18; E02D 27/42; E02D 13/00

See application file for complete search history.

(56) References Cited

U.S. PATENT DOCUMENTS

| | | | | |
|---|---|---|---|---|
| 3,241,326 | A | 3/1966 | Guild et al. | |
| 4,472,085 | A | 9/1984 | Mohler | |
| 5,549,168 | A * | 8/1996 | Sadler | E02D 7/18 173/129 |
| 5,595,363 | A * | 1/1997 | De Leebeeck | F16L 3/24 248/72 |
| 6,390,734 | B1 | 5/2002 | Marshall | |
| 6,722,821 | B1 | 4/2004 | Perko et al. | |
| 8,070,391 | B2 * | 12/2011 | White | E02D 7/06 405/231 |
| 8,371,771 | B1 | 2/2013 | Lugo et al. | |
| 10,378,171 | B2 | 8/2019 | Maersch et al. | |
| 2005/0074298 | A1 | 4/2005 | Jones | |
| 2005/0163616 | A1 | 7/2005 | Mortensen | |
| 2006/0088388 | A1 | 4/2006 | Wissmann et al. | |
| 2010/0215429 | A1 * | 8/2010 | Raye | B60C 23/10 248/220.21 |
| 2012/0114425 | A1 | 5/2012 | Seider et al. | |
| 2014/0138427 | A1 * | 5/2014 | Nagatsu | B23K 37/08 228/264 |
| 2016/0218659 | A1 | 7/2016 | Matsuyama et al. | |
| 2020/0283980 | A1 * | 9/2020 | Plotkin | E02D 5/54 |

* cited by examiner

*Primary Examiner* — Carib A Oquendo
(74) *Attorney, Agent, or Firm* — Boyle Fredrickson, S.C.

(57) ABSTRACT

An H-pile caisson includes side tabs that can be gripped by side-mounted clamps on a vibratory hammer so that the caisson may be lifted into position from a horizontal position, oriented vertically, and driven into the ground without readjustment of the clamping of the vibratory hammer. A bolted side-extending base plate provides a mounting surface for a pole while allowing a continuous section of the H-pile to be received directly by the vibratory hammer.

14 Claims, 5 Drawing Sheets

ELECTRICAL POLE WITH H-WEB CAISSON

CROSS REFERENCE TO RELATED APPLICATION

This application claims the benefit of U.S. provisional application 63/268,213 filed Feb. 18, 2022, and hereby incorporated by reference

STATEMENT REGARDING FEDERALLY SPONSORED RESEARCH OR DEVELOPMENT

- -

BACKGROUND OF THE INVENTION

The present invention relates to earth-supported piles ("caissons"), for example, as are used as foundations for electrical poles and in particular to a caisson providing reduced installation time and cost.

Construction projects, for example, routing high-voltage electrical transmission lines, may require placement and setting of a large number of poles to support high voltage electrical conductors safely above the ground, free from interference. The foundations for these poles may be provided by tubular steel caissons embedded in the ground to be supported by the surrounding earth. The tubular form of these caissons provides for great strength against arbitrary horizontal loading, and the open lower ends offer low resistance to the caisson being driven downward through the earth which may pass along the inside and outside of the tubular steel walls. Accordingly, when soil conditions are right, caissons are normally installed by vibration or driving them directly into the earth without first preparing a hole.

Installing caissons directly into the ground may be done with a vibratory hammer applying a rapid series of high force impacts to the top of the caisson typically through a specially installed protective cap fitting over the caisson end. The vibratory hammers have internal eccentric weights, for example, driven by a hydraulic motor and have a hydraulic clamp that may clamp the vibratory hammer tightly to the protective cap and caisson to directly couple forces from the vibratory hammer into the caisson walls. The vibratory hammers are normally associated with a large weight providing an inertial backstop against which the hammer may operate. This weight is coupled to the vibratory hammer with an asymmetric elastomeric coupling that promotes high downward forces but attenuated upward forces so that the net progress of the caisson moves downward during vibration.

The current process for installing a caisson using a vibratory hammer may require a crew to install the protective cap on the caisson and an on-site crane to lift the caisson into vertical orientation. A second crane holding the vibratory hammer may then be positioned above the caisson and clamped to the protective cap to drive the caisson into the earth. The protective cap is then removed and the pole installed on the portion of the caisson projecting above the ground. This process is repeated for each caisson to be installed with a typical project requiring many hundreds of caissons.

U.S. Pat. No. 10,370,171, assigned to the assignee of the present invention and hereby incorporated by reference, describes a tubular caisson having side tabs (vangs) allowing vibratory forces to be effectively transferred from an offset position to a side of the caisson through the tabs into the caisson. The availability of these tabs permits the caisson to be installed with greatly reduced time and labor by using the vibratory hammer to both position the caisson (by gripping the side tabs and lifting the caisson when the caisson is on the ground) and to drive the caisson into the earth without the need for separate equipment or repositioning of the vibratory hammer.

SUMMARY OF THE INVENTION

The present inventors have recognized that in electrical pole applications lateral pole loading, for example, from wind, is largely shared in the direction of the transmission line among multiple poles allowing the strength of the caisson to be concentrated to resist bending loads across path of the transmission line. This permits the tubular caisson to be replaced with oriented H piles that can be compatible with a wider range of soil conditions. Butt welded tabs may be directly attached to the H-pile walls aligned with the pile web with reduced risk of wall distortion problems associated with hollow caissons.

These recognitions by the present inventors allow the design of a caisson having a number of benefits including: (1) reducing fabrication costs of the caisson thru simplified design as a result of directional loading concept, (2) increasing load carrying capability of a standard steel shape through a change in member cross-section design, (3) improving corrosion resistance/maintenance through elimination of enclosed surfaces, (4) providing improved drivability in stiffer soils through a change in member cross-section, (5) improving tab attachment to a surface that reduces weld cracking because of the lateral stiffness of the H-web design.

These particular objects and advantages may apply to only some embodiments falling within the claims and thus do not define the scope of the invention.

DETAILED DESCRIPTION OF THE PREFERRED EMBODIMENT

Figure 1:
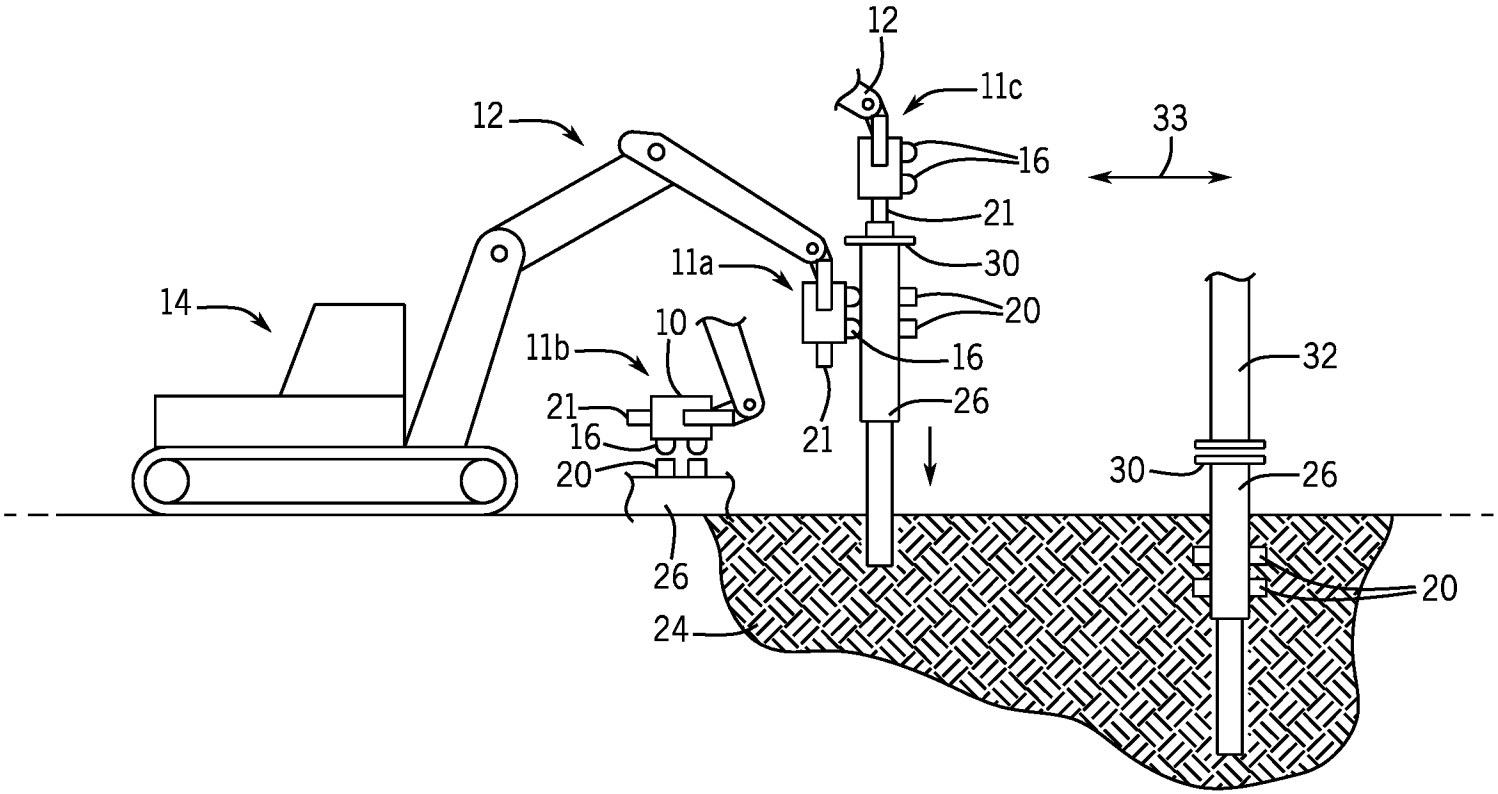
FIG. 1 is a simplified diagram of an excavator-mounted vibratory hammer lifting a caisson by gripping side tabs on a caisson, using those same side tabs to drive the caisson into the ground, and then repositioning the vibratory hammer on a special tabs on the base plate to drive the remainder of the caisson into the ground when the side tabs reach ground-level.
Figure 6:
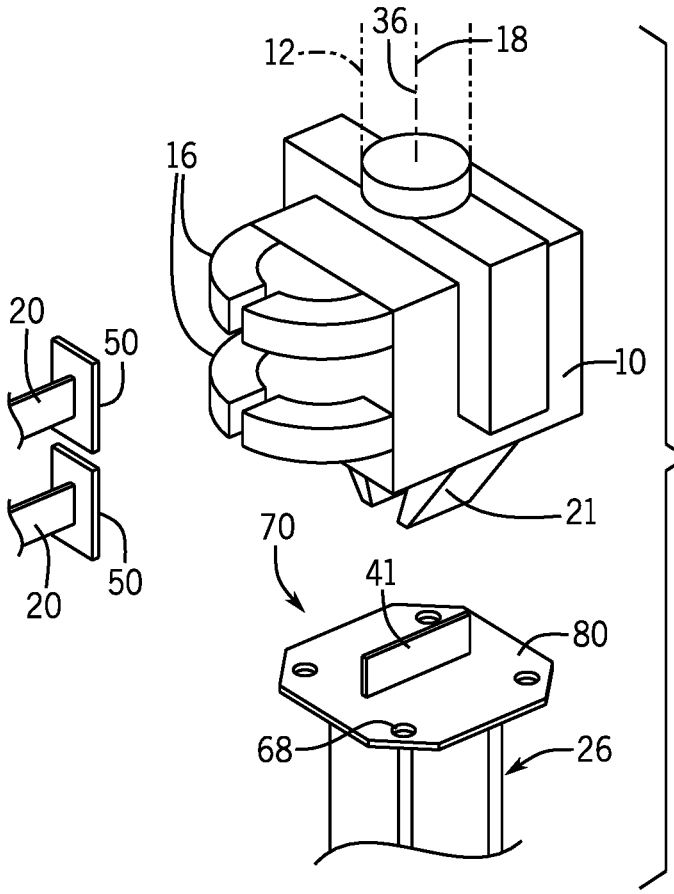
FIG. 6 is a simplified diagram of a vibratory hammer providing side and bottom clamping capabilities showing a welded mounting plate.

Referring now to FIG. 1, a system for installing caissons into the earth may employ a vibratory hammer 10 supported on the end of an articulated arm 12 of an excavator 14 or the like. Referring also to FIG. 6, the vibratory hammer 10 may provide for upper and lower side clamps 16 displaced along a hammer axis 18 defining a direction of force applied by the vibratory hammer during a driving operation and extending perpendicularly to that hammer axis 18. Each of the side clamps 16 may open and close across a plane aligned with the hammer axis 18 in a clamping direction perpendicular to that plane, for example, as actuated by hydraulic cylinders (not shown). In addition, the vibratory hammer 10 may provide a hydraulically actuated lower clamp 21 extending downward along the hammer axis 18 also opening and closing in a direction perpendicular to the hammer axis 18.

Referring still to FIG. 1, the vibratory hammer 10 may be mounted to the excavator arm 12 so as to be movable in elevation above the ground with the hammer axis 18 vertical (shown by position 11*a*) and rotated to move the hammer axis 18 to a horizontal position (shown by position 11*b*) with the side clamps 16 facing downward and to rotate the vibratory hammer 10 about the hammer axis 18. This motion may be provided by actuator control of a joint between the arm 12 and the vibratory hammer 10 or articulation of the arm 12 or movement of the excavator 14 as is generally understood in the art.

As so mounted on the arm 12, the vibratory hammer 10 is first positioned above a caisson body 26 lying on the ground in position 11*b* so that the side clamps 16 may grip tabs 20 extending from one or two opposite sidewalls of the caisson body 26. Combined movement of the arm 12 and rotation of the vibratory hammer 10 may then be used to lift the caisson body 26 into a vertical orientation with the vibratory hammer in position 11*a* and still gripping the tabs 20 in the side clamps 16. Finally, without release of the tabs 20 gripped by the side clamps 16 of the vibratory hammer 10, the vibratory hammer 10 may be activated to drive the caisson body 26 into the earth 24 using vibratory forces conducted through the tabs 20 into the caisson body 26 from the vibratory hammer 10 offset to the side of the caisson body 26.

Referring still to FIG. 1, the caisson body 26 may be driven into the earth 24 with the vibratory hammer 10 moving downward along a straight line path without rotation until the vibratory hammer 10 is proximate to the surface of the earth 24. At that point, the side clamps 16 of the vibratory hammer 10 may be released and the vibratory hammer 10 moved to position 11*c* where the lower clamp 21 of the vibratory hammer 10 may engage an upper flange 28 on a protective base plate 30 at the upper end of the caisson body 26. In this position, the vibratory hammer 10 may be activated again to transmit vibrations through the base plate 30 while continuing to drive the caisson body 26 into the ground until the tabs 20 are buried in the earth 24.

At this point, the vibratory hammer 10 may be removed by releasing the lower clamp 21, and a pole 32 may be installed on the base plate 30, for example, by a bolt ring completing the installation of the pole 32 on the foundation provided by the caisson body 26. Generally, this process may repeated to establish a line of poles 32 interconnected by transmission lines (not shown) passing between poles 32 along a transmission line direction 33.

Figure 2:
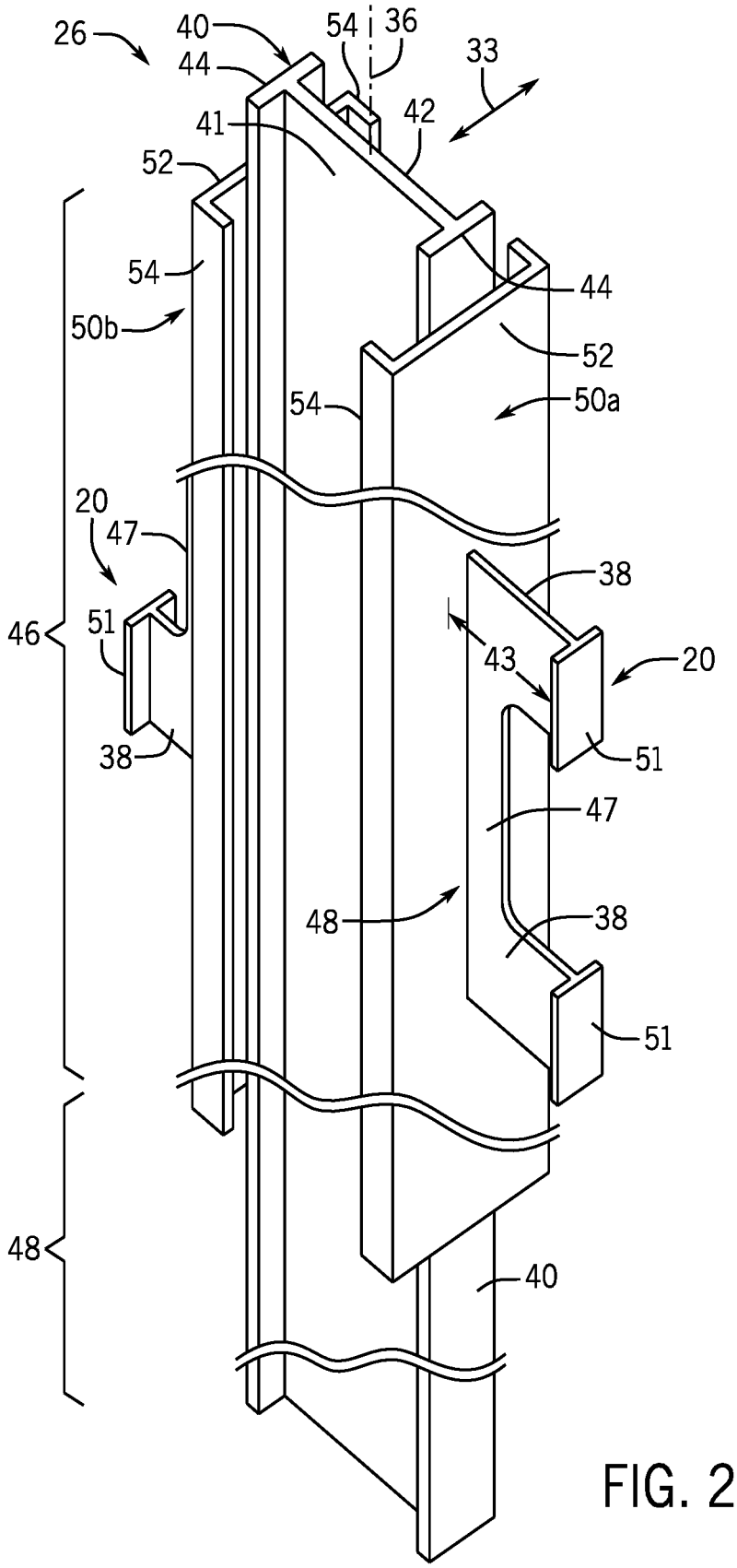
FIG. 2 is a fragmentary perspective view of a caisson providing axially spaced tabs on opposite sides of the caisson body for gripping in either of two orientations.

Referring now also to FIG. 2, the caisson body 26 ("H-piling") may provide for a central H-beam extending along a vertical axis 36 as installed. As used herein, H-beam will be used to generally indicate cross-sectional shapes similar to the letter I or H and thus including so-called: I beams, H-beams, W-beams, and the like. The H-beam 40 includes an H-beam web 42 connecting the centers of flanking H-beam flanges 44 per conventional H-beam rolled steel shapes. The H-beam web 42 will generally be perpendicular to the transmission line direction 33 so as to maximize resistance to bending in that perpendicular direction. In one embodiment, the H-beam web 42 measured between the flanges 44 may be 12 inches or more.

In a first embodiment as depicted, the caisson body 26 may be divided between an upper reinforced portion 46 and a lower unreinforced portion 48, the latter consisting solely of the H-beam 40. The upper reinforced portion 46 reinforces the H-beam 40 with a first and second C-channel 50*a* and 50*b* having C-channel webs 52 welded to respective outer surface of the H-beam flanges 44 with C-channel flanges 54 of each C-channel 50 extending inwardly toward the other C-channel 50. In one embodiment, the C-channel web 52 may have a width of 12 inches or more between the C-channel flanges 54 and may also be a standard rolled steel shape.

The H-beam 40 may extend slightly above the C-channels 50 to provide a tab portion 41 to be gripped by the clamp 21 of the vibratory hammer 10.

Referring still to FIG. 2, a pair of tab plates 38 may be attached to and extend from opposite sides of the caisson body 26 by a distance 43. These tab plates 38 provide the tabs 20 accessible at the outer wall of the caisson body 26 on one or each side of the caisson body 26. The distance 41 will be set to closely equal to a minimum distance required to receive the side clamps 16 of the vibratory hammer 10 to clamp about the exposed portion of each tab 20, ensuring that the side clamps 16 are positioned as close as possible to the caisson body 26. Normally the extension will be approximately eight inches and no less than six inches. A vertical extent of each tab plate 38 and its vertical separation distance between the tab plates 38 may also be dictated by the size of the side clamps 16 so as to provide a surface large enough to fully contact the entire clamping face of the side clamps 16. In this case, there is no need to limit the dimension which may be in excess of eight inches. The height of the tab plates 38 on the caisson body 26 will be dictated by the need to balance the caisson body 26 to be moved by the excavator arm 12 as discussed above and ideally will be close to the center of mass of the caisson body 26.

Each tab plate 38 may be joined by a tie plate 47 (for example, being cut from a single plate of material with the tab plates 38) extending from the caisson body 26 by a fraction of the distance 41 and providing a continuous inner edge with 48 tab plates 38 that may be butt welded to the outer surface of the C-channel web 52. The tab plates 38 and tie plate 47 will generally be aligned in a same plane as the H-beam web 42 with a vertical orientation providing minimal earth resistance when the caisson body 26 is driven into the ground. The tab plates 38 may, for example, be 3/16-inch thick steel but will generally be less than ¾ of an inch in thickness while providing sufficient strength.

Stop elements 51 may be placed on the distal ends of the tabs 20 to reduce the possibility that the caisson body 26, held by the vibratory hammer 10 with its side clamps 16 on the tabs 20, will slip from the grip of the side clamps 16. In one embodiment, the stop elements 51 may be steel plates butt welded to the distal ends of the tabs 20 extending in a plane perpendicular to the plane of the H-beam web 42. As so positioned, the stop elements 51 may engage an inner side of the side clamps 16 when the side clamps 16 are closed to prevent such slippage. The stop element 51 may be fashioned from plate steel having a thickness comparable to the thickness of the tab plates 38 so as to easily pass into the ground as the caisson body 26 is driven into the earth 24.

Figure 3:
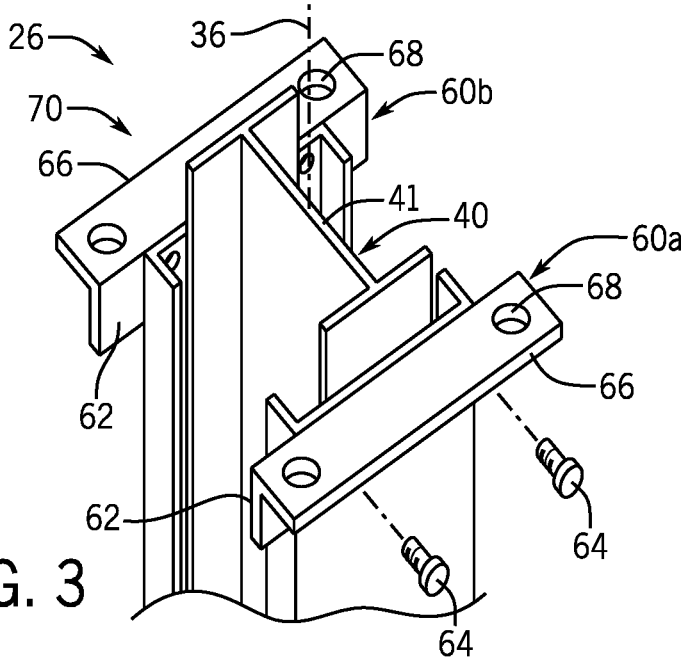
FIG. 3 is a fragmentary perspective view of a mounting plate for bolt attachment to the top of the caisson for receiving a pole.
Figure 4:
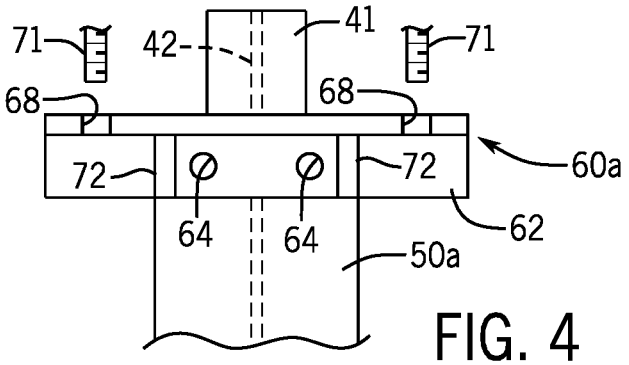
FIG. 4 is a fragmentary side elevational view of the bolt mounting system of FIG. 3.

Referring now to FIGS. 3 and 4, in one embodiment, the base plate 30 may be provided by a set of angle brackets 60*a* and 60*b* having downwardly extending flanges 62 abutting the outer surfaces of respective C-channel webs 52 and bolted thereto using corresponding bolt holes and bolts 64. The remaining horizontally oriented flanges 66 of the angle bracket 60 are positioned to extend outwardly from the caisson body 26 and are aligned in a plane perpendicular to the axis 36 to define a base plate 70 that may receive a corresponding surface of a base plate of pole 32 for bolted interconnection. For this purpose, one or more bolt holes 68 may be cut through the horizontal flanges 66 at appropriate locations so that the angle flanges 60 may be used to provide a bolted connection between the caisson body 26 and the pole 32. The angle brackets 60 may include gusset plates 72 welded between the outer surfaces of the downward flanges 62 and horizontal flanges 66 to join the perpendicularly opposed faces for additional strength.

Figure 5:
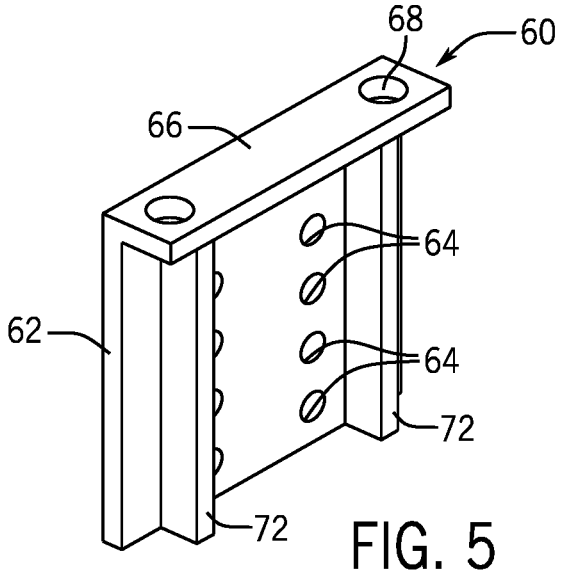
FIG. 5 is an alternative embodiment of the mounting plate of FIG. 3 providing increased bolt attachment area.

Referring now to FIG. 5, in one embodiment the downwardly extending flanges 62 of the angle brackets 60 may be increased in height to provide for additional bolt holes 64 and points of connection between the downwardly extending flanges 62 and the corresponding outer surfaces of the C-channels 50 to better resist shear forces between these elements caused by lateral loads on the pole 32.

Figure 7A:
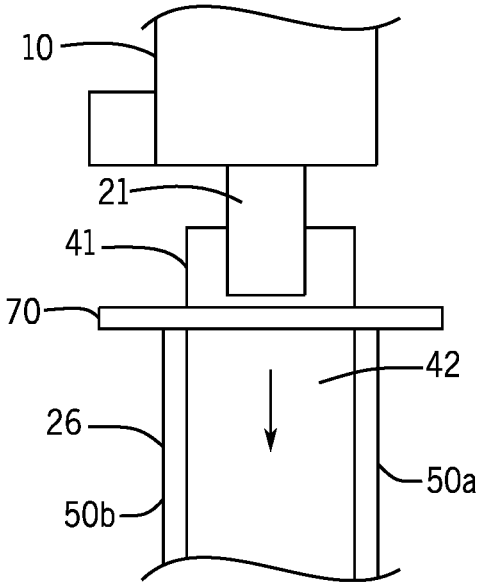
FIGS. 7*a*-7*b* are figures showing positioning of the hammer on the flange of FIG. 6 for completion of the driving process and attachment of a pole portion to the base plate without removal of the flange.
Figure 7B:
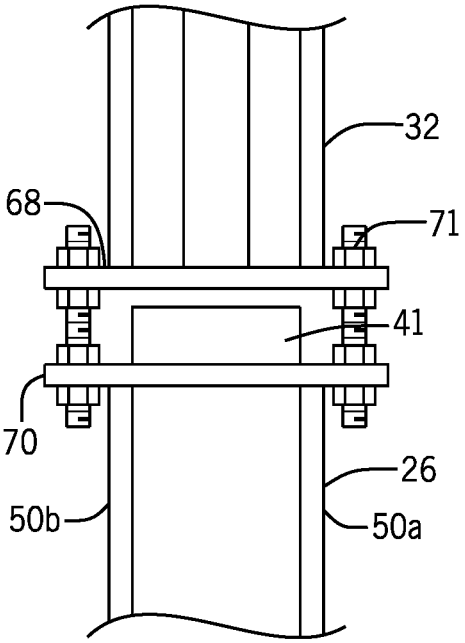

Referring now to FIGS. 6, 7*a*, and 7*b*, in an alternative embodiment, a base plate 70 providing a substantially continuous horizontal surface 80 may be attached to the upper end of the caisson body 26, for example, by welding the base plate 70 to the upper edges of the C-channels 50 adding reinforcing gussets as necessary.

In all cases, (including the embodiments of FIGS. 3-5) centered within base plate 70 is an upwardly extending H-beam tab 41 which may be gripped by lower clamp 21 of the vibratory hammer 10 at position 11*c* shown in FIG. 1 so that the caisson body 26 may be driven further into the ground to a distance where the tabs 20 are buried. The mounting surfaces of the base plate 70 extend generally perpendicularly to the axis 36 outside of a surrounding perimeter of the caisson body 26 and the upwardly extending H-beam tab 41 so that an inner diameter of a lower end of a tubular pole 32 may fit around the upwardly extending H-beam tab 41 when the pole 32 is installed on the base plate 70, for example, using a corresponding bolt plate 66 attached to the pole 32 with adjustable standoffs 71 comprised of threaded rods, nuts and washers. When the pole 32 is installed on the caisson body 26, the bolt holes 68 and adjustable standoff 71 are accessible. Generally, the base plate 70 may be installed on the caisson body 26 after the caisson body 26 is installed in the ground and later adjusted to level the tubular pole 32 by moving the nuts along the threaded rods of the adjustable standoffs 71.

Figure 8:
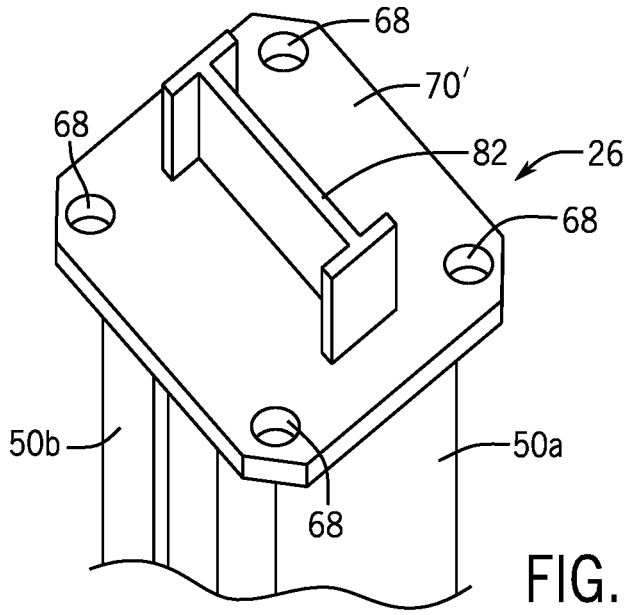
FIG. 8 is a figure similar to FIG. 3 showing a simplified welded mounting plate.

Referring now to FIG. 8 in an alternative embodiment, the angle brackets 60 shown in FIGS. 3 and 4 may be replaced with a single base plate 70' providing the horizontal surface 80, for example, and welded to the upper edges of the C-channel 50*a* and 50*b* and/or the upper edge of H-beam 40. A single vertically extending tab 82, for example being part of a H-beam, is welded to upper surface of the base plate 70', serving to replace the web 42 of H-beam tab 41 as shown in FIG. 3, to be gripped by the vibratory hammer 10 (FIG. 6).

The base plate 70 (FIG. 3) may be preferred over base plate 70' (FIG. 8) as reducing the risk of weld fractures and the weight of the caisson body 26 during installation, but offers a reduced load rating and thus may be favored for a lighter weight caisson body 26 discussed below with respect to FIG. 9. An advantage to the base plate 70' is that it is permanently affixed and need not be removed or modified for installation of the pole 32 on top of the base plate 70, further reducing installation time and effort.

Figure 9:
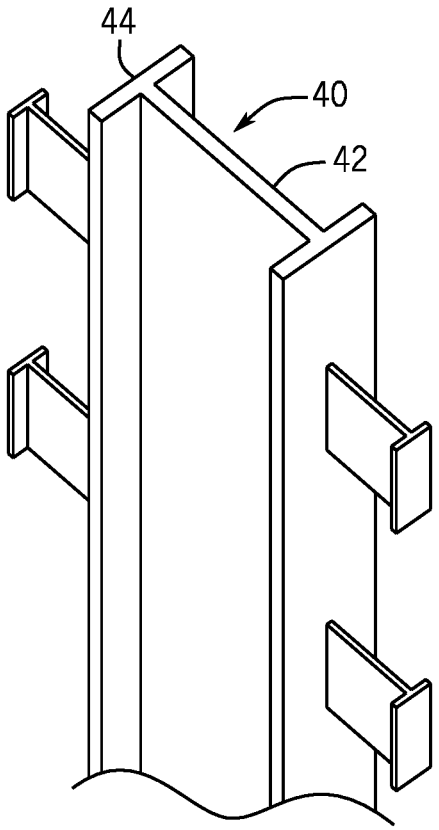
FIG. 9 is a figure similar to FIG. 2 showing a simplified H-piling.

Referring now to FIG. 9, a lighter weight version of the caisson body 26 shown in FIG. 2 may eliminate the C-channels 50*a* and 50*b* and attach the tabs 20 directly to the outer surface of the flanges 44 of the H-beam 40. Either the base plate 70 or bolt plate 70' discussed above may be used in this embodiment. Here, the tabs are shown without and interconnecting web.

The above described components including the tab plates 38 may be galvanized steel with other protective coatings. By providing the tab plates 38, damage to these coatings on the main portions of the caisson are prevented.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What I claim is:

1. A caisson for vibratory installation comprising:

an H-caisson body extending along an axis and having an axially extending web positioned between and attached to transversely opposed inner surfaces of a pair of axially and transversely extending flanges;

at least one tab attached to an outer surface of at least one of the transversely extending flanges to extend outwardly to be received by clamp jaws of a vibratory caisson driver, the attachment of the at least one tab adapted to conduct force applied to the tab to the web only through the at least one of the transversely extending flanges;

a pole attachment plate extending perpendicularly to the axis and providing for bolt attachment to an electrical pole; and further including a stop member attached to an outer end of the at least one tab to project laterally with respect to an axis of tab projection from the caisson.

2. The caisson of claim 1 wherein the tab extends outwardly in a plane of the web.

3. The caisson of claim 1 wherein the tab provides two axially separated plates extending outwardly from the flange by a first distance and joined by a vertically extending tie bar extending outwardly from the flanged by a second distance less than the first distance, each plate butt welded to the flange.

4. The caisson of claim 1 wherein the web is formed from an H-beam and the flanges are C-channels attached to H-beam flanges.

5. The caisson of claim 4 wherein the C-channels provide peripheral C-flanges directed parallel to the H-beam web and inwardly toward the opposed C-channel.

6. The caisson of claim 4 wherein the H-beam extends by a greater axial distance than the C-channels.

7. The caisson of claim 4 wherein the C-channels provide peripheral C-flanges directed parallel to the H-beam web and inwardly toward the opposed C-channel.

8. The caisson of claim 4 wherein the H-beam extends by a greater axial distance than the C-channels.

9. The caisson of claim 1 further including a stop member attached to an outer end of the at least one tab to project laterally with respect to an axis of tab projection from the caisson.

10. A transmission line comprising:

a series of transmission towers;

a set of transmission tower foundations embedded in the ground and supporting corresponding transmission towers, each foundation providing:

an H-caisson body extending along an axis and having an axially extending web positioned between and attached to transversely opposed inner surfaces of a pair of axially and transversely extending flanges;

at least one tab attached to an outer surface of at least one of the transversely extending flanges to extend outwardly to be received by clamp jaws of a vibratory caisson driver, the attachment of the at least one tab adapted to conduct force applied to the tab to the web only through the at least one of the transversely extending flanges; and a pole attachment plate extending perpendicularly to the axis and providing for bolt attachment to an electrical pole; and a set of transmission lines connecting adjacent towers along a transmission line direction;

wherein the webs of the H-caisson bodies are oriented to extend perpendicularly to the transmission line direction.

11. The method of claim 10 wherein the tab extends outwardly in a plane of the web.

12. The method of claim 10 wherein the tab provides two axially separated plates extending outwardly from the flange by a first distance and joined by a vertically extending tie bar, each plate butt welded to the flange.

13. The method of claim 10 wherein the web is formed from an H-beam and the flanges are C-channels attached to H-beam flanges.

14. The method of claim 10 further including a stop member attached to an outer end of the at least one tab to project laterally with respect to an axis of tab projection from the caisson.

* * * * *